US005985099A

United States Patent [19]

Jourdain et al.

[11] Patent Number: 5,985,099

[45] Date of Patent: Nov. 16, 1999

[54] PAPER-MAKING MACHINE HEADBOX WITH PARTIAL PARTITIONS

[75] Inventors: Jean-Pierre Jourdain, Rives; Gérard Pionchon, Renage; Jean-Claude Roux, Meylan; Martine Rueff, Grenoble, all of France

[73] Assignee: Allimand (Societe Anonyme), Rives, France

[21] Appl. No.: 08/750,858

[22] PCT Filed: May 2, 1996

[86] PCT No.: PCT/FR96/00667

§ 371 Date: Mar. 24, 1997

§ 102(e) Date: Mar. 24, 1997

[87] PCT Pub. No.: WO96/35017

PCT Pub. Date: Nov. 7, 1996

[30] Foreign Application Priority Data

May 2, 1995 [FR] France ..... 95 05449

[51] Int. Cl.[6] ..... D21F 1/02

[52] U.S. Cl. ..... 162/343; 162/258

[58] Field of Search ..... 162/336, 343, 162/258

[56] References Cited

U.S. PATENT DOCUMENTS

| | | | |
|---|---|---|---|
| 3,216,892 | 11/1965 | Wahlstrom | 162/343 |
| 4,406,741 | 9/1983 | Kirjavaninen | 162/336 |
| 4,534,399 | 8/1985 | Steen | 162/343 |
| 4,980,027 | 12/1990 | Keller | 162/343 |
| 5,304,285 | 4/1994 | Meinecke et al. | 162/343 |
| 5,549,792 | 8/1996 | Begemann et al. | 162/336 |
| 5,626,178 | 5/1997 | Merath | 162/343 |
| 5,695,611 | 12/1997 | Bubik et al. | 162/343 |
| 5,707,495 | 1/1998 | Heinzmann et al. | 162/343 |

FOREIGN PATENT DOCUMENTS

| | | | |
|---|---|---|---|
| 462472 | 12/1991 | European Pat. Off. | 162/336 |
| 1158105 | 7/1969 | United Kingdom . | |

*Primary Examiner*—Karen M. Hastings
*Attorney, Agent, or Firm*—Bacon & Thomas PLLC

[57] ABSTRACT

In the headbox of a papermaking machine;

the backplate has a diverging passage for each tube and opens out into the corresponding channel via its largest section; and the partitions are of length shorter than the length of the chamber between the backplate and the turbulence generator.

The invention is useful for paper-making machines in which dilution is controlled upstream.

13 Claims, 2 Drawing Sheets

PAPER-MAKING MACHINE HEADBOX WITH PARTIAL PARTITIONS

TECHNICAL FIELD

The present invention relates to the field of paper-making, and more particularly to the field of producing a sheet of paper continuously from fiber pulp diluted in an aqueous medium also incorporating presently-known additives.

In the above field, it is normal practice to provide the fiber solution in a compartment called a headbox whose function is to feed a nozzle opening out through two close-together lips above a conveyor belt whose first function is to drain the solution to start the sheet-forming process and whose second function is to convey the sheet to successive units that together constitute a machine for producing paper continuously.

Such technology is widely known, as are the requirements specific to a headbox which can be fed by means of a back distributor communicating with the headbox proper via a perforated backplate.

It is considered necessary to generate turbulence in the fiber solution in order to maintain good uniformity and good distribution prior to equalizing the solution upstream from the nozzle for applying and spreading it on the conveyor belt.

In such a feed system, it has been observed that currents or streams become established causing fibers to be concentrated in certain zones to such an extent that the resulting sheet cannot be considered as being homogeneous. Uncontrollable local changes in fiber orientation have also been observed which likewise give rise to non-homogeneous finished products.

In general, it is therefore desirable to be able to control fiber concentration and orientation.

PRIOR ART

That is why proposals have been made to implement apparatuses that are still in service and that consist in enabling at least one of the lips of the nozzle to be deformed in such a manner as to modulate the flow section so as to favor certain application and spreading zones in consideration of the distribution width of the nozzle.

That constitutes some kind of adjustment means acting downstream from the headbox, "downstream" being considered relative to the flow direction through the headbox from feed inlet to application and spreading.

Such means make it possible to regulate the density of the applied pulp, but it is then observed that favored fiber orientations appear. Such means therefore do not enable both parameters to be controlled.

In an attempt to improve the operation of a headbox and to eliminate or reduce the negative effects of the control that may be provided by means of the deformable lips of the nozzle, another technology has been recommended.

That technology causes the headbox to be fed from an installation that delivers an aqueous solution which is conveyed by means of feed tubes or pipes at the back of the headbox where said tubes or pipes are connected to connection pieces extending parallel to one another.

That technique makes it possible to improve control over local feed compared with a conventional distributor, but it does not suffice to provide a solution to the problem posed.

Improvements have been made to such a technique by proposing to partition the reception chamber of the headbox to define internal channels each corresponding to a respective feed tube. That is the teaching given by application WO 88/01318. It would appear that that disposition has not provided all of the looked-for improvements.

Proposals have subsequently been made to associate the various back feed-tubes with dilution adjustment blocks including respective adjustable valves for the tubes making it possible to adjust the specific dilution of the solution delivered by each tube by adding aqueous medium independently. By way of example, such a proposal is taught by application DE 4 019 593.

That technique was expected to make upstream adjustment of the headbox possible to achieve control over the sheet as applied and spread, thereby controlling and adjusting density in the cross direction more effectively, to obtain a product that is uniform.

That technology has indeed provided improvements, but it would appear that it does not enable the problem posed to be completely settled. In practice it turns out that it is still necessary to adjust the nozzle flow section by deforming one of the nozzle's lips to modify its flow section locally in an attempt to master the problems of fiber density and orientation.

OBJECTS OF THE INVENTION

The object of the invention is to propose structural and functional improvements to a headbox fitted with a feed system applying the proposal outlined above.

The improvements of the present patent of addition seek to achieve more effective control over homogenous distribution of the fiber solution within the headbox so that by taking into consideration certain favored streams that occur naturally it is possible for density matching to be controlled by matching dilution upstream without adjusting the flow section of the feed nozzle, thus avoiding the various hazards to which that gives rise, including undesired localized orientation of the fibers.

Another object of the invention is to provide technical improvement means that can be implemented easily in a conventional headbox structure without it being necessary, once installed, for essential, frequent, and accurate adjustments to be performed, all of which requirements go against a manufacturing process that is continuous, as is the case in the process for producing a sheet of paper.

Another object of the invention is to provide means of a static nature which, once installed, are not subject to adjustment or change in their relative position to the extent of requiring surveillance and periodic maintenance which likewise go against a manufacturing process that is continuous.

Another advantage of the invention is to propose improvement means which also make it possible to provide easy and quick access to the component elements of the headbox to the extent of making it possible, when the need arises, to clean it quickly without requiring long and complicated dismantling.

SUMMARY OF THE INVENTION

To achieve the above objects, the headbox for a papermaking machine is of the type comprising an admission backplate having n feed tubes connected thereto delivering papermaking pulp at controlled dilution, a mixing chamber following the backplate and into which the tubes open out, a turbulence generator defining the chamber remote from the backplate and separating said chamber from a lip nozzle for applying and spreading the pulp on an endless drainage conveyor belt, said mixing chamber being provided with fixed partitions subdividing it into as many channels as there are tubes, wherein:

the admission backplate has a diverging passage for each tube opening out via its largest section into the corresponding channel; and the partitions are shorter than the length of the chamber between the backplate and the turbulence generator.

Various other characteristics appear from the following description given with reference to the accompanying drawings which show an embodiment of the invention by way of non-limiting example.

MORE DETAILED DESCRIPTION

Figure 1:
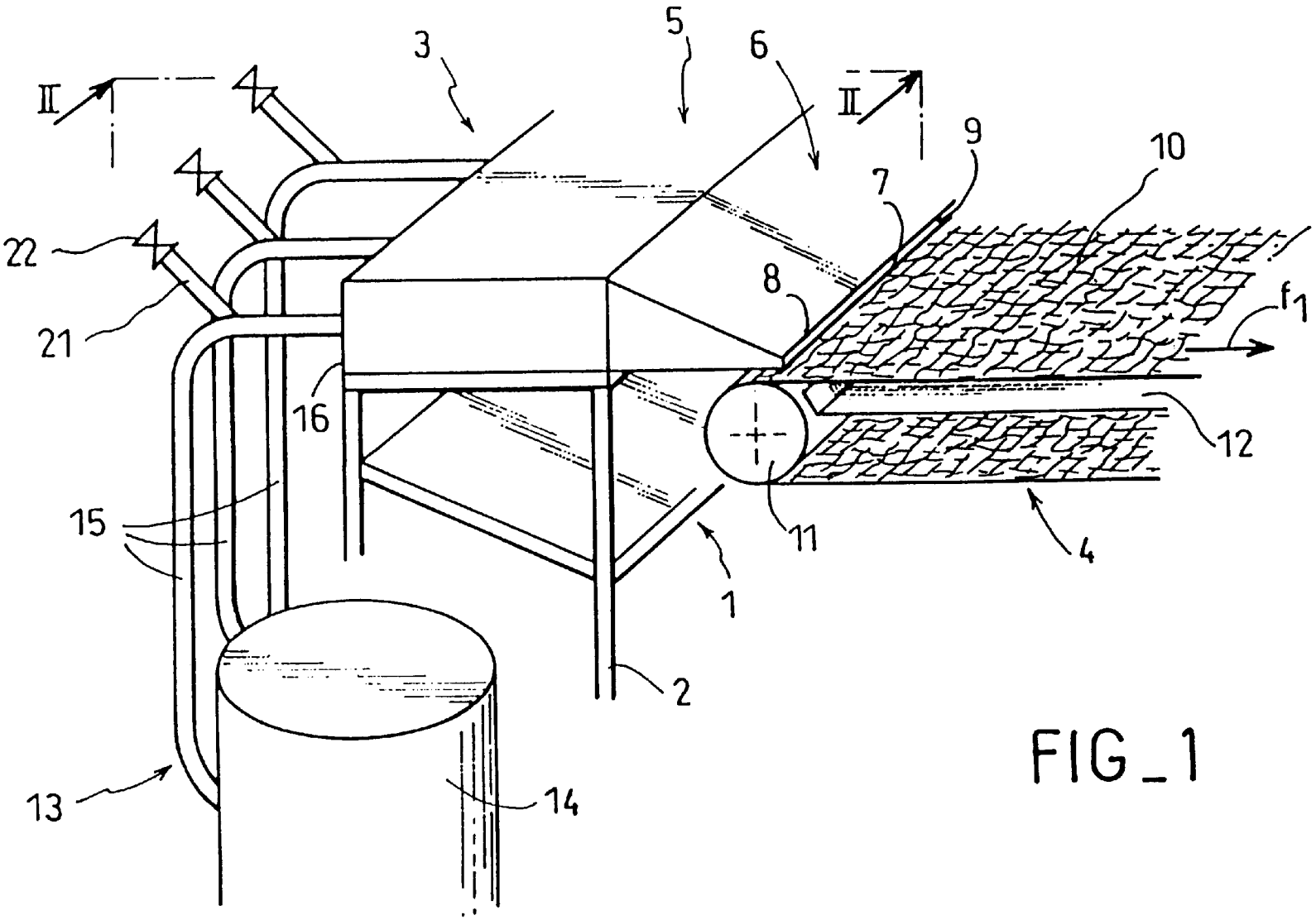
FIG. 1 is a fragmentary diagrammatic view of a headbox for a machine for making a sheet of paper continuously.

FIG. 1 shows a portion of the upstream end of a machine 1 for making a sheet of paper continuously. In conventional manner, such a machine comprises a frame or the like 2 carrying various functional subassemblies with only parts of the two upstream subassemblies being shown. These two subassemblies comprise the feed installation 3 and the drainage and conveyor belt 4 whose function is recalled below.

The installation 3 comprises a headbox 5 mounted in any appropriate manner on the frame 2 and possessing an outlet constituted by a nozzle 6 defined by two lips 7 and 8 which between them define a flow section 9 for the purpose of pouring onto the belt 4 the fiber solution that is subsequently to constitute the sheet. The section 9 is situated above the top strand 10 of the belt 4 which extends between cylinders or rollers 11, at least one of which is motor-driven, so that the top strand is caused to move in the direction of arrow $f_1$.

In a manner shown diagrammatically, the underside of the top strand 10 is associated with equipment 12 having the purpose of recovering the liquid drained through the top strand 10 and of recirculating the recovered liquid fraction.

The headbox 5 is of the type fed by an assembly 13 comprising a tank 14 delivering fiber solution to n tubes or pipes 15 which are connected directly via appropriate connection pieces to a backplate 16 constituting the headbox 5.

In the prior art, and also in the literature or in most works relating to the structure and function of a headbox, it is generally recommended to place a "mixing" chamber in the headbox between the outlets of the various tubes or pipes 15 and the nozzle 6 for the purpose of homogenizing and equalizing the feed streams delivered by the various tubes 15. In spite of this homogenizing function, it is necessary to make use of means for adjusting and deforming the lip 8, for example, in order to adjust and adapt the distribution profile of the water-and-fiber composition poured continuously onto the top strand 10.

Because of the variation in the section of the outlet 9, such adjustment means gives rise to the fibers included in the solution being pre-oriented and irregularly distributed which does not favor obtaining a sheet of uniform quality.

In fact, the homogenizing function of the chamber could be considered as being effective, at least in theory, if the mixing chamber were of sufficient flow length between the various tubes 15 and the nozzle 6. However, it is not possible in practice to make such a chamber that satisfies that requirement because of cost and bulk and also because of operating problems that a long chamber would introduce, e.g. such as the fiber solution behaving in a manner that runs the risk of uncontrollable flocculation.

Given that the eqalizing chamber cannot be omitted, the improvements recommended by the present invention seek to alter such a chamber both structurally and functionally in order to satisfy the generally posed problem as mentioned above.

Figure 2:
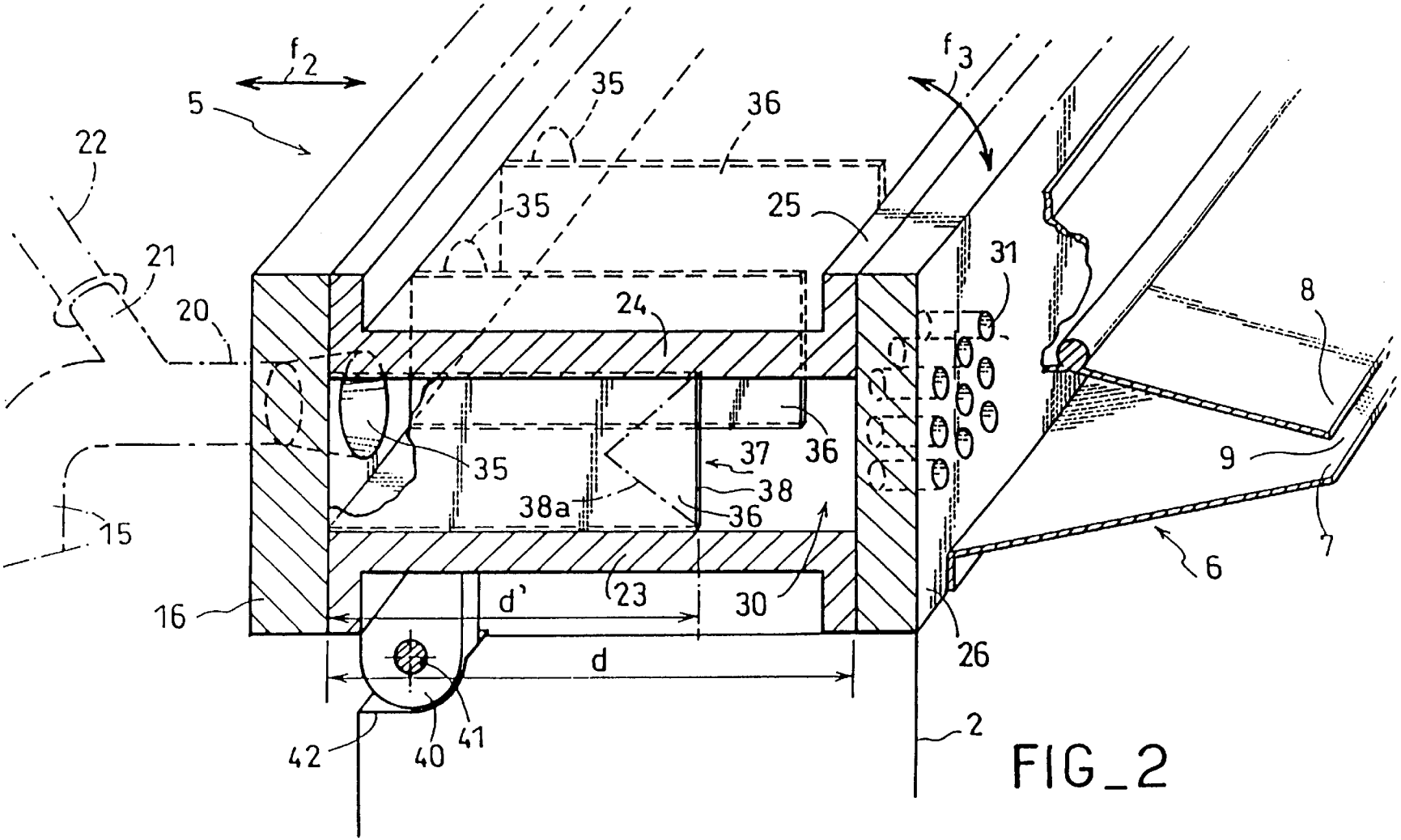
FIG. 2 is a perspective view and section on plane II—II of FIG. 1.

In FIG. 2, the headbox 5 comprises a backplate 16 provided at intervals with coupling pieces 20 to which the various feed tubes or pipes 15 are connected, each of which is associated with a dilution duct 21 controlled by a valve 22. Each duct 21 is connected at its upstream end to a source for supplying a liquid for diluting the fiber suspension conveyed by the corresponding pipe 15.

BEST METHOD OF PERFORMING THE INVENTION

According to the invention, the headbox 5 is made in the form of a box comprising a bottom wall 23 and a top wall 24 which are connected to the backplate 16 and secured by respective flanges 25 to at least one turbulence generator 26 on which the nozzle 6 is fitted. Two end walls (not shown) are provided to close the sides of the working volume defined in this way and given overall reference 30, which volume may be referred to as a "mixing" chamber. In one embodiment, the turbulence generator 26 is constituted by a frontplate having passages 31 suitably distributed to create streams for feeding the nozzle 6.

According to the invention, the backplate 16 is made in such a manner that each connection piece 20 has a passage 35 having a diverging portion whose large base faces into the chamber 30. The diverging portion 35 serves to constitute a transition zone bringing the fiber solution supplied by the pipe 15 progressively to occupy an increased volume in right cross-section, thereby favoring progressive expansion between the section of the pipe 15 and the chamber 30. The divergence angle of the passages 35 advantageously lies in the range 1° to 10°.

In a disposition of the invention, the chamber 30 is subdivided internally by fixed partitions 36 which extend parallel to one another, so as to define as many channels 37 as there are diverging passages 35, such that each of them corresponds to a channel 37.

Given the existence of the end walls which are necessarily provided to define the mixing chamber 30 in association with the backplate 16, the bottom 23, the top 24, and the turbulence generator 26, the number of partitions 36 is equal to the number of diverging passages 35 minus 1.

In a disposition of the invention, the partitions 36 are in contact with the backplate 16 and are secured to the facing faces of the bottom wall 23 and of the top wall 24. In addition, each of the partitions is of length d' that is less than the length d of the mixing chamber 30 between the facing faces of the backplate 16 and the turbulence generator 26. The partition length d' is given by the formula KD where K lies in the range 4 to 10 and D corresponds to the hydraulic diameter.

The hydraulic diameter D is given by the following formula:

$$D = \frac{2Ll}{L+l}$$

in which L is the width of the right cross-section of a channel 37 constituting the mixing chamber 30, while l is the height of the same section.

The difference in length between the partitions and the chamber can lie in the range 5 mm to 100 mm.

A headbox made as described above enables the following effects to be obtained.

Firstly, the fiber solution or pulp delivered by the tube 15 is subjected to gentle mixing in each diverging passage 35, thereby favoring its entry into the corresponding channel 37 enabling its progress to be channeled under conditions that are not immediately turbulent, throughout its progress where guided by the partitions 36. When the solution goes past the free edges of the partitions, it enters the common portion in which the various streams corresponding to the various channels 37 mix partially in their lateral zones prior to being subjected to homogenizing division by means of the turbulence generator 26.

Thus, not only is the nozzle 6 fed continuously, but it is also fed with the presence of longitudinal streams that are more or less well-marked because of the presence of the channels 37 that channel progress of each stream through the major portion of its transit through the chamber 30, while also enabling relative transverse dilution to take place during progress through the common portion of the chamber 30 prior to the turbulence generator 26.

In this way, upstream control can be maintained effectively and accurately by adjusting the valves 22 which deliver an accurate dilution rate for each stream, consequently enabling such a dilution rate to be maintained in spite of the homogenization that takes place in the common portion of the chamber 30, thus enabling the nozzle 6 to be fed in the most appropriate manner to ensure that the distribution profile corresponds to the desired transverse density and to the looked-for orientation of fibers on the belt 4 shown in FIG. 1.

In another disposition of the invention, the mixing chamber 30 is implemented in the form of an independent chest constituted by the backplate 16 and the walls 23 and 24 and also by optional end walls, and said chest is made relatively movable, e.g. in back-and-forth rectilinear motion as represented by arrow $f_2$ to facilitate cleaning operations. Relative displacement can be maintained by any drive means enabling the chest to be moved away from and towards the turbulence generator 26, whenever it is appropriate to gain access to the inside of the chamber 30 and of the channels 37.

In the embodiment shown, each partition 36 has a rectilinear transverse edge 38 extending perpendicularly between the faces of the walls 23 and 24. The partitions 36 may be made with respective edges that are rectilinear and sloping or indeed notched, as shown in chain-dotted lines under reference 38*a*.

The connection between the chest and the turbulence generator 26 can be made by any appropriate means, in particular by means of the flange 25, making use of gaskets (not shown in the drawings).

Another movable configuration consists in mounting the chest constituting the headbox on tabs or the like 40 pivoted on an axis 41 parallel to the turbulence generator 26 and carried by one or more forks 42 presented by, formed on, or fitted to the frame 2 or a chest facing the chamber 30.

Any appropriate form of drive means may be provided to pivot the chest in either of the directions of double-headed arrow $f_3$ on a circular path to open the headbox relative to the turbulence generator 26 and thus facilitate maintenance operations, as mentioned above.

Although not shown, any drive means may be provided and fitted as a function of the knowledge of the person skilled in the art to provide such a function, and, when movable in the direction of arrow $f_2$, headbox guide means can also be provided between the headbox and the facing frame 2 or chest.

The invention is not limited to the examples described and shown since various modifications may be applied thereto without going beyond the ambit of the invention.

INDUSTRIAL APPLICATION

The preferred industrial application of the invention lies in machines for making paper for reproduction purposes.

We claim:

1. A headbox for a paper-making machine, the headbox comprising:

a backplate having n feed tubes connected thereto for delivering paper pulp at a controlled dilution;

a mixing chamber following the backplate into which the n feed tubes open;

a turbulence generator defining the chamber remote from the backplate;

a nozzle following the turbulence generator and separated from the chamber thereby, the nozzle having lips for applying and spreading the pulp on an endless drainage and conveyor belt; and fixed partitions subdividing the chamber into n channels corresponding to the n feed tubes, the partitions being in contact with the backplate and being of a length shorter than the length of the chamber between the backplate and the turbulence generator, the length of the partitions satisfying the formula d'=KD where:

d' equals the length of each partition;

K lies in the range 4 to 10; and

D corresponds to the hydraulic diameter.

2. A headbox for a paper-making machine, the headbox comprising:

a backplate having n feed tubes connected thereto for delivering paper pulp at a controlled dilution;

a mixing chamber following the backplate into which the n feed tubes open;

a turbulence generator defining the chamber remote from the backplate;

a nozzle following the turbulence generator and separated from the chamber thereby, the nozzle having lips for applying and spreading the pulp on an endless drainage and conveyor belt; and fixed partitions subdividing the chamber into n channels corresponding to the n feed tubes, the partitions being in contact with the backplate and being of a length shorter than the length of the chamber between the backplate and the turbulence generator, each partition having a notched transverse edge facing the turbulence generator.

3. A headbox according to claim 2, wherein the length of the partitions satisfies the formula d'=KD where:

d' equals the length of each partition;

K lies in the range 4 to 10; and

D corresponds to the hydraulic diameter.

4. A headbox according to claim 1 or 3, wherein the hydraulic diameter D satisfies the formula:

$$D = \frac{2Ll}{L+l}$$

in which L is the width of the cross section of a channel of the mixing chamber, and l is the height of the same cross section.

5. A headbox according to claim 1, 2 or 3, wherein, for each tube, the backplate has a diverging passage opening out into the corresponding channel via its largest section.

6. A headbox according to claim 5, wherein the diverging passages having diverging conicity in the range 1° to 10°.

7. A headbox according to claim 1, 2 or 3, wherein the partitions are in contact with the backplate and are secured to bottom and top walls defining the mixing chamber.

8. A headbox according to claim 1, 2 or 3, wherein the difference in length between the partitions and the chamber lies in the range 5 mm to 100 mm.

9. A headbox according to claim 1, wherein, facing the turbulence generator, each partition has a rectilinear transverse edge.

10. A headbox according to claim 1, 2 or 3, comprising: a chest that is independent from the turbulence generator, said chest being mounted such that it is movable relative to the turbulence generator.

11. A headbox according to claim 10, wherein the independent chest comprises: the backplate, a top wall, a bottom wall, the partitions, and a flange for engaging against the turbulence generator.

12. A headbox according to claim 10, wherein the chest is mounted to move along a rectilinear path parallel to the partitions.

13. A headbox according to claim 10, wherein the chest is mounted to pivot about an axis parallel to the plane of the turbulence generator.

* * * * *